US009555467B2

(12) United States Patent
Poon et al.

(10) Patent No.: US 9,555,467 B2
(45) Date of Patent: Jan. 31, 2017

(54) AMORPHOUS STEEL COMPOSITES WITH ENHANCED STRENGTHS, ELASTIC PROPERTIES AND DUCTILITIES

(71) Applicant: University of Virginia Patent Foundation, Charlottesville, VA (US)

(72) Inventors: S. Joseph Poon, Charlottesville, VA (US); Gary J. Shiflet, Charlottesville, VA (US); Xiao-Jun Gu, Cleveland, OH (US)

(73) Assignee: University of Virginia Patent Foundation, Charlottesville, VA (US)

( * ) Notice: Subject to any disclaimer, the term of this patent is extended or adjusted under 35 U.S.C. 154(b) by 0 days.

(21) Appl. No.: 14/714,826

(22) Filed: May 18, 2015

(65) Prior Publication Data

US 2016/0031002 A1 Feb. 4, 2016

Related U.S. Application Data

(63) Continuation of application No. 11/884,917, filed as application No. PCT/US2006/006709 on Feb. 23, 2006, now Pat. No. 9,051,630.

(60) Provisional application No. 60/656,224, filed on Feb. 25, 2005, provisional application No. 60/655,796, filed on Feb. 24, 2005.

(51) Int. Cl.

| | |
|---|---|
| ***C22C 45/02*** | (2006.01) |
| ***C22C 45/00*** | (2006.01) |
| ***B22D 7/00*** | (2006.01) |
| ***C22C 1/10*** | (2006.01) |
| ***C22C 33/02*** | (2006.01) |
| ***C22C 35/00*** | (2006.01) |

(52) U.S. Cl.

CPC ..... *B22D 7/00* (2013.01); *C22C 1/1042* (2013.01); *C22C 33/0228* (2013.01); *C22C 35/005* (2013.01); *C22C 45/02* (2013.01); *B22F 2998/10* (2013.01)

(58) Field of Classification Search

None

See application file for complete search history.

*Primary Examiner* — Yoshitoshi Takeuchi

(74) *Attorney, Agent, or Firm* — Robert J. Decker

(57) ABSTRACT

Amorphous steel composites with enhanced mechanical properties and related methods for toughening amorphous steel alloys. The composites are formed from monolithic amorphous steel and hard ceramic particulates, which must be embedded in the glass matrix through melting at a temperature above the melting point for the steel but below the melting point for the ceramic. The ceramics may be carbides, nitrides, borides, iron-refractory carbides, or iron-refractory borides. The produced composites may be one of two types, primarily distinguished by the methods for embedding the ceramic particulates in the steel. These methods may be applied to a variety of amorphous steels as well as other non-ferrous amorphous metals, and the resulting composites can be used in various applications and utilizations.

36 Claims, 4 Drawing Sheets

AMORPHOUS STEEL COMPOSITES WITH ENHANCED STRENGTHS, ELASTIC PROPERTIES AND DUCTILITIES

CROSS-REFERENCES TO RELATED APPLICATIONS

This application is a continuation application under 35 U.S.C. §120 of U.S. patent application Ser. No. 11/884,917, filed Aug. 22, 2007, which is a national stage filing of International Application No. PCT/US2006/006709, filed Feb. 23, 2006, which claims priority under 35 U.S.C. §119(e) to U.S. Provisional Patent Applications Ser. No. 60/655,796 filed on Feb. 24, 2005, entitled "Amorphous Steel Composites with Enhanced Ductilities, Strengths and Elastic Properties," and Ser. No. 60/656,224 filed Feb. 25, 2005, entitled "Amorphous Steel Composites with Enhanced Ductilities, Strengths and Elastic Properties," the entire disclosures of which are hereby incorporated by reference herein in their entirety.

This application is related to U.S. application Ser. No. 11/313,595, filed Dec. 21, 2005, entitled "Non-Ferromagnetic Amorphous Steel Alloys Containing Large-Atom Metals," which is a Continuation-in-Part of U.S. application Ser. No. 10/559,002, the entire disclosure of which is hereby incorporated by reference herein in its entirety.

This application is related to U.S. application Ser. No. 10/559,002, filed Nov. 30, 2005, entitled "Non-ferromagnetic Amorphous Steel Alloys Containing Large-Atom Metals," which is a national stage filing of International Application No. PCT/US2004/016442, filed on May 25, 2004, the entire disclosure of which is hereby incorporated by reference herein in its entirety.

U.S. GOVERNMENT RIGHTS

This invention was made with United States Government support under ONR Grant No. N00014-01-1-0961, awarded by the Defense Advanced Research Projects Agency/Office of Naval Research. The United States Government has certain rights in the invention.

BACKGROUND OF THE INVENTION

Recently, non-ferromagnetic amorphous steels based on Fe—Mn—Cr—Mo—C—B and Fe—(Mn,Cr)-(Ln,Y)—Mo—C—B (Ln=Lanthanides) bulk metallic glass (BMG), known as DARVA-Glass 1 and DARVA-Glass 101, respectively, have been reported (DARVA is abbreviation for DARPA-University of VIRGINIA; See International Patent Application Serial No. PCT/US03/04049, filed Feb. 11, 2003, entitled "BULK-SOLIDIFYING HIGH MANGANESE NON-FERROMAGNETIC AMORPHOUS STEEL ALLOYS AND RELATED METHOD OF USING AND MAKING THE SAME," and corresponding U.S. application Ser. No. 10/364,123, filed Feb. 11, 2003, and International Patent Application Serial No. PCT/US2004/016442, filed May 25, 2004, entitled "NON-FERROMAGNETIC AMORPHOUS STEEL ALLOYS CONTAINING LARGE-ATOM METALS," and corresponding U.S. application Ser. No. 10/559,002, filed Nov. 30, 2005, of which all of their respective disclosures are hereby incorporated by reference herein in their entirety [1, 2, 3]. DARVA-Glass 101 exhibits highly glass forming ability, and samples with diameter thicknesses of 12 mm can be obtained by copper mold injection casting. Hereafter, DARVA-Glass 1 and Glass 101 will be called DVG 1 and DVG 101. Separately, another research group has produced similar Fe-based metallic glasses based on the results reported in reference no. 1, and therefore compositions similar to DVG 101 [4] The fracture yield strengths of amorphous steels are found to be three times those of high-strength stainless steel alloys, and their elastic moduli observed in the range 150-200 GPa are comparable to super-austenitic steels. Furthermore, in the supercooled liquid regions, amorphous steels can be bent into various configurations by hand or compressed by as much as 40% under a pressure of only 20% of the fracture strength. The high processability and high mechanical strengths coupled with good corrosion resistance properties and superplastic behavior suggest that DVG amorphous steels can potentially be developed as formable non-ferromagnetic amorphous steel alloys [1, 2, 3]. The present amorphous steel compositional spreads reported in PCT/US03/04049 and PCT/US2004/016442 have included those regions that result in brittle as well as ductile samples, with measured or estimated fracture toughness ranging from 4.0 MPa-m [1,2,5] to above 10 MPa-$m^{1/2}$. Prior to utilizing amorphous steels as structural materials, one must first improve the toughness of these DVG steels so that they will have a higher resistance to fracture.

In the 1980s', metallic-glass composites were synthesized by rapidly solidifying glass-forming melts embedded with ceramic particulate matter, and also by laminating thin amorphous metal layers with sheets of metal matrix (see referenced patents). Recently, BMG composites using ductile dendrites and hard particulates as reinforcements had been developed [6-14]. In addition to the two-phase BMG composites that were formed in more ductile Zr-based BMG, BMG composites were also developed for brittle monolithic BMG, such as the Mg-based BMG [13, 14]. The plastic deformation in monolithic BMG tends to be localized in narrow regions called shear bands, which under stress, will lead to unconstrained propagation of the shear bands, resulting in catastrophic material failure. The enhanced plastic strain to failure, or toughness, reported was attributed to impediment of run-away shear bands as well as formation of multiple shear bands in the presence of ductile crystalline phases or hard particulate matters. As a result, any further deformation will take place through the occurrence of shear bands elsewhere in the sample and the elongation is greatly improved. In some BMG forming alloys, two-phase crystalline microstructures consisting of ductile Zr—Ti-based β phases were formed in-situ in the bulk metallic glass matrix via chemical partitioning in the melt and primary dendritic growth [7-9]. Meanwhile, other BMG were found to devitrify to form composites that contain embedded crystalline or quasicrystalline particles [10-12]. In yet another method of forming BMG composites, a master alloy ingot with the glass forming composition was combined with metal or ceramic particles and induction melted to form the composite ingot, followed by casting to form BMG composite samples [6, 13, 14]. A significant increase in the plastic strain to failure ranging from ~1 to more than 15% was demonstrated, while the corresponding monolithic BMG exhibited only 0 to 1% plastic strain [6-11, and 13, 14].

As for the DVG amorphous steels, although carbides and borides are formed at high temperatures, ductile austenitic phase has not been obtained. Meanwhile, there are reasons to believe that amorphous steels can be reinforced with hard ceramic particles to form a more ductile product. In designing amorphous steel composites, ceramic particulates with Vickers hardness and stiffness significantly larger than those of amorphous steels are selected (Table I). However, due to the high liquidus temperature (near 1200° C.) and high viscosity of the DVG liquids, previous approach of melting mixtures of master alloy ingots and ceramic particles is inadequate for producing samples with uniformly distributed embedded particulates without compromising the glass-forming composition.

An aspect of various embodiments of the present invention provides, among other things, practical methodologies that can be successfully applied to produce DVG amorphous steel composites with enhanced mechanical properties and ductility.

SUMMARY OF INVENTION

An aspect of various embodiments of the present invention provides, among other things, bulk-solidifying amorphous steel composites known as DVG 101 composites that exhibit enhanced fracture strengths and elastic moduli in comparison with monolithic DVG 101, as well as fracture features that indicate improved ductility. Although the present disclosure focuses on amorphous steels reinforced with hard and stiff particulates principally the refractory-carbides, iron-refractory-carbides, or iron-refractory-borides, other suitable ceramic and even intermetallic particulates can also be incorporated following the approaches prescribed. For example, a number of the latter ceramic compounds are well known (Table I). In view of the brittle fracture behavior noted in monolithic DVG 101, it is necessary to consider the blunting (or blocking) of shear band and crack propagation simultaneously. The design and processing of the present invention amorphous steel composites circumvent partial devitrification in forming glass-matrix composites that usually results in the embrittlement of the glass matrix. Equally important, the present methods also circumvent the need for mixing highly viscous molten amorphous steel with ceramic particles at very high temperatures in order to produce a homogeneous mixture. Overheating can result in a significant alteration of the glass forming composition that can lead to a reduced glass forming ability. Thus, an aspect of the present invention synthesis methods retain much of the high glass forming ability of DVG 101, enabling the production of amorphous steel composite rods with a robust glass matrix that are at least about 4 mm in diameter, and can be larger. A critical thickness for forming the amorphous composites depend on the composition. The composition of the glass matrix is therefore similar to that of DVG 101 amorphous steel [2, 3].

An aspect of various embodiments of the present invention provides, among other things, bulk-solidifying amorphous steel products that represent a new milestone in the development of amorphous steel alloys. An aspect of the various embodiments of the present invention also provides, but not limited thereto, related methods of using and making articles (e.g., systems, structures, components) of the same.

According to the methods to be described herein, an aspect of the present invention comprises two types of two (or three)-phase amorphous steel composites, hereafter called type-1 and type-2 DVG composites (Table II). Type-1 composites are DVG 101 composites that contain principally binary or psuedo-binary carbide particulates of the Group 4 (Ti, Zr, Hf) and Group 5 (V, Nb, Ta) refractory metals, such as TiC, NbC, (Ti,Zr,Hf)C, (Nb,Ti)C for example, but not limited thereto. Ingots are prepared by melting composite precursors that are uniformly blended mixtures of DVG 101 and ceramic particulates. The design of type-1 DVG composites has utilized the high viscosity of the DVG liquids and large melting point gaps that exist between DVG 101 and ceramic particulates (e.g. $T_l$(DVG) ~1160° C., $T_l$(ceramic)~2500-3000° C.). Combining with the high thermal stability of the ceramic particulates, homogenous alloy ingots with desired microstructures (particle size and spatial distribution) can be synthesized. Also, both the homogeneity and microstructure of the blended materials can be retained if the temperature is kept much below $T_l$(ceramic). Type-2 composites are DVG 101 composites with in-situ grown binary (and pseudo-binary) or -ternary (and pseudo-ternary) carbide and boride particulates formed by second-phase precipitation during solidification of the alloy melt. Examples of these particulate phases include those mentioned for type-1 composites (i.e. TiC, (Ti,Nb)C, etc.) as well as $Fe_{23}C_6$, $Fe_2MoC$, $Fe_3Mo_3C$, and $FeMo_2B_2$, for example, but not limited thereto, where Fe, Mo, and the metalloids can also be substituted with other elements from the iron, refractory-metal, or metalloid series in the Periodic Table. One method of making Type-2 composite ingots is by adding appropriate combinations of refractory metals, metalloids, carbides, and borides to molten DVG 101. The ingots are then cast into rod-shaped samples by injection-mold casting. In other methods of making type-2 composites with preferred microstructures, additional alloying procedures are implemented to encourage the homogeneous precipitation of ceramic phases upon cooling the melt.

The present invention exhibits non-ferromagnetic properties at ambient temperature as well as enhanced mechanical properties that exceed those of monolithic amorphous steels. The present invention is the first reported castable amorphous steel composites (i.e. products of up to several millimeters thick or there about) for non-ferromagnetic structural applications. Compared with monolithic amorphous steels, the present invention alloys exhibit magnetic transition temperatures below the ambient, enhanced strengths and elastic moduli, some ductility, and good corrosion resistance. Furthermore, since the synthesis-processing methods employed by the present invention only use industrial grade raw materials and do not involve any special materials handling procedures, they are directly adaptable to low-cost industrial processing.

Preliminary measurements in an embodiment of the present invention show microhardness in the range of about 11-13 GPa, compression fracture strengths of about 4 GPa or higher, stiffness of~220-240 GPa, bulk modulus~200-230 GPa, shear modulus ~82-90 GPa, Poisson ratio~0.32-0.35. Except for the hardness, the measurements reveal a 5-20% increase above those reported for DVG 101 amorphous steels. Some typical results for the composites based on brittle $Fe_{48}Cr_{15}Mo_{14}Er_2C_{15}B_6$DVG 101 are listed in Table III. Further, preliminary indications provide that the composites based on ductile DVG 101 compositions are estimated to have Poisson's ratios of 0.34-0.35, comparable to many ductile amorphous metals as well as crystalline metals. Similar to previous amorphous steel alloys, the present invention exhibits good corrosion resistance properties comparable to those observed in DVG101. The fracture surfaces upon bending or compressing the sample rods show multiple shears and some cracks around the particles, including particle pullout, in contrast to the brittle crack structural features seen in the monolithic alloys. The deformation behaviors seen in the composites give some indications of ductility.

It should be appreciated that, although the design and processing methods described are immediately applicable to both non ferromagnetic and ferromagnetic amorphous steel composites, similar approaches can be utilized for synthesizing other non-ferrous BMG composites particularly if the host material exhibits a high liquidus (melting) temperature $T_l$ and high viscosity.

Furthermore, it should be appreciated that the principles demonstrated for toughening amorphous steels in the present invention can be applied to process two-phase or other multiphase amorphous steel composites produced by non-casting methods such as compaction and extrusion. The reinforcement additives can include a wide range of refractory as well as non-refractory ceramic particles. The DVG-ceramic mixtures can be consolidated inside the supercooled liquid region of the amorphous steel to form near-net-shaped products. [3]

It should be appreciated that the steps discussed throughout this document may be performed in various orders and/or with modified procedures or compositions suitable to a given application.

An aspect of various embodiments of the present invention provides an amorphous steel composite comprised substantially of a composition represented by the formula:

$$[Fe_{1-a-b-c-d-e-f}Mn_aCr_bMo_c(Ln_{1-x}Y_x)_dC_eB_d]_{100-\alpha}[CER]_\alpha,$$

wherein Ln represents an element in the Lanthanide series such as Sm, Gd, Dy, Er, Yb, or Lu; and wherein CER represents a ceramic consisting of one of three types:

i) a carbide or nitride comprised substantially of a composition represented by the formula: $Mo_{0.5-y}M'_yC_{0.5-z}N_z$, wherein M and M' represent one or two group IV or V refractory metals such as Ti, Zr, Hf, V, Nb, or Ta, and wherein y and z satisfy the relations $0.5 \geq y \geq 0$ and $0.5 \geq z \geq 0$;

ii) an iron-refractory carbide comprised substantially of a composition represented by the formula: $Fe_{1-y-z}M_yC_z$, wherein M represents a refractory or reactive metal, and wherein y and z satisfy the relations $1.0 \geq y \geq 0$ and $1.0 \geq z \geq 0$; or iii) an iron-refractory boride comprised substantially of a composition represented by the formula: $Fe_{1-y-z}M_yB_z$, wherein M represents a refractory or reactive metal, and wherein y and z satisfy the relations $1.0 \geq y \geq 0$ and $1.0 \geq z \geq 0$; and wherein a, b, c, d, e, f, x, and $\alpha$ satisfy the relations: $0.12 \geq a \geq 0$, $0.18 \geq b \geq 0$, $0.18 \geq c \geq 0.05$, $0.03 \geq d > 0$, $0.18 \geq e \geq 0.12$, $0.1 \geq f \geq 0.05$, $1.0 \geq x \geq 0$, $12 \geq \alpha > 0$, $c+d \leq 0.19$, $e+f \leq 0.25$, and $a+b+c+d+e+f \leq 0.55$. Further, the amorphous steel composite as set forth herein may have a the partial composite of $[Fe_{1-a-b-c-d-e-f}Mn_aCr_bMo_c(Ln_{1-x}Y_x)_dC_eB_f]_{100-\alpha}$, further comprising elements X and/or Z, wherein: X represents at least one of transitional elements, and Z represents at least one Group B elements.

An aspect of various embodiments of the present invention provides a method for producing of amorphous steel alloy that comprises the steps: a) milling carbide or nitride ceramic particulates to obtain a desired particle size distribution; b) mixing the milled particles with ingots of monolithic amorphous steel alloy; c) compacting the mixture to form a pellet; and c) melting the pellet at a temperature above the melting point for the steel but below the melting point for the ceramic to form a composite ingot. Further, the method may comprise the steps: a) preparing ingots of monolithic amorphous steel alloy; and b) casting the resulting ingot to form an amorphous steel composite. Finally, the above-referenced methods may provide a composition represented by the formula: $[Fe_{1-a-b-c-d-e-f}Mn_aCr_bMo_c(Ln_{1-x}Y_x)_dC_eB_f]_{100-\alpha}[CER]_\alpha$ or further comprise X and/or Z to provide a composition as $[Fe_{1-a-b-c-d-e-f}Mn_aCr_bMo_c(Ln_{1-x}Y_x)_dC_eB_fXZ]_{100-\alpha-\alpha}[CER]_\alpha$, wherein: X represents at least one of transitional elements, and Z represents at least one Group B elements.

An aspect of various embodiments of the present invention provides a method for producing amorphous steel alloy that comprises the steps: a) combining monolithic amorphous steel with Carbon, Boron, or Nitrogen to form a master alloy ingot; b) melting the master alloy ingot at a temperature above the melting point for the steel but below the melting point for the ceramic; c) mixing a group IV or V refractory metal in the melt to form ceramic particulates within the composite ingot; and d) repeating the process as necessary to achieve the desired particle size and ceramic content. Further, the method may comprise the steps: a) preparing ingots of monolithic amorphous steel alloy; and b) casting the resulting ingot to form an amorphous steel composite. Finally, the above-referenced methods may provide a composition represented by the formula: $[Fe_{1-a-b-c-d-e-f}Mn_aCr_bMo_c(Ln_{1-x}Y_x)_dC_eB_f]_{100-\alpha}[CER]_\alpha$ or further comprise X and/or Z to provide a composition as $[Fe_{1-a-b-c-d-e-f}Mn_aCr_bMo_c(Ln_{1-x}Y_x)_dC_eB_fXZ]_{100-\alpha-\alpha}[CER]_\alpha$, wherein: X represents at least one of transitional elements, and Z represents at least one Group B elements.

An aspect of various embodiments of the present invention provides a method for producing amorphous steel alloy that comprises the steps: a) milling ceramic particulates to obtain a desired particle size distribution; b) mixing the ceramic particulates with ingots of monolithic amorphous steel alloy; c) melting the mixture at a temperature above the melting point for the steel but below the melting point for the ceramic; and d) precipitating the ceramic particulates from the mixture as it cools into a composite ingot. Further, the method may comprise the steps: a) preparing ingots of monolithic amorphous steel alloy; and b) casting the resulting ingot to form an amorphous steel composite. Finally, the above-referenced methods may provide a composition represented by the formula: $[Fe_{1-a-b-c-d-e-f}Mn_aCr_bMo_c(Ln_{1-x}Y_x)_dC_eB_f]_{100-\alpha}[CER]_\alpha$ or further comprise X and/or Z to provide a composition as $[Fe_{1-a-b-c-d-e-f}Mn_aCr_bMo_c(Ln_{1-x}Y_x)_dC_eB_fXZ]_{100-\alpha-\alpha}[CER]_\alpha$, wherein: X represents at least one of transitional elements, and Z represents at least one Group B elements.

An aspect of various embodiments of the present invention provides a method producing feedstock for the amorphous steel composite comprising the steps: a) preparing a precursor by melting together a group IV or V refractory metal with Chromium or Molybdenum; b) preparing a separate precursor by melting together Iron, Erbium, and Iron Boride with Chromium or Molybdenum and either Carbon, Boron, or Nitrogen; and c) melting the two precursors at a temperature above the melting point for the steel but below the melting point for the ceramic to form a single ingot. Further, the method may comprise the step of casting said ingot to form an amorphous steel composite. Finally, the above-referenced methods may provide a composition represented by the formula: $[Fe_{1-a-b-c-d-e-f}Mn_aCr_bMo_c(Ln_{1-x}Y_x)_dC_eB_f]_{100-\alpha}[CER]_\alpha$ or further comprise X and/or Z to provide a composition as $[Fe_{1-a-b-c-d-e-f}Mn_aCr_bMo_c(Ln_{1-x}Y_x)_dC_eB_fXZ]_{100-\alpha-\alpha}[CER]_\alpha$, wherein: X represents at least one of transitional elements, and Z represents at least one Group B elements.

An aspect of various embodiments of the present invention provides a method for producing feedstock for the amorphous steel composite that comprises the steps: a) preparing a precursor by melting together a group IV or V refractory metal with Chromium or Molybdenum in combination with about 20 to 40% of the desired Iron content;

b) preparing a separate precursor by melting together the remaining Iron content with Erbium and Iron Boride, Chromium or Molybdenum, and either Carbon, Boron, or Nitrogen; and c) melting the two precursors at a temperature above the melting point for the steel but below the melting point for the ceramic to form a single ingot. Further, the method may comprise the step of casting said ingot to form an amorphous steel composite. Finally, the above-referenced methods may provide a composition represented by the formula: $[Fe_{1-a-b-c-d-e-f}Mn_aCr_bMo_c(Ln_{1-x}Y_x)_dC_eB_f]_{100-\alpha}[CER]_\alpha$ or further comprise X and/or Z to provide a composition as $[Fe_{1-a-b-c-d-e-f}Mn_aCr_bMo_c(Ln_{1-x}Y_x)_dC_eB_f XZ]_{100-\alpha-\alpha}[CER]_\alpha$, wherein: X represents at least one of transitional elements, and Z represents at least one Group B elements.

An aspect of various embodiments of the present invention provides amorphous steel composites with enhanced mechanical properties and related methods for toughening amorphous steel alloys. The composites may be formed from monolithic amorphous steel and hard ceramic particulates, which shall be embedded in the glass matrix through melting at a temperature above the melting point for the steel but below the melting point for the ceramic. The ceramics may be carbides, nitrides, borides, iron-refractory carbides, or iron-refractory borides. The produced composites may be one of two types, which may be primarily distinguished by the methods for embedding the ceramic particulates in the steel. These methods may be applied to a variety of amorphous steels as well as other non-ferrous amorphous metals, and the resulting composites can be used in various applications and utilizations.

These and other aspects of the disclosed technology and systems, along with their advantages and features, will be made more apparent from the description, drawings and claims that follow.

BRIEF DESCRIPTION OF THE DRAWINGS

The accompanying drawings, which are incorporated into and form a part of the instant specification, illustrate several aspects and embodiments of the present invention and, together with the description herein, serve to explain the principles of the invention. The drawings are provided only for the purpose of illustrating select embodiments of the invention and are not to be construed as limiting the invention.

DETAILED DESCRIPTION OF THE INVENTION

Figure 1A:
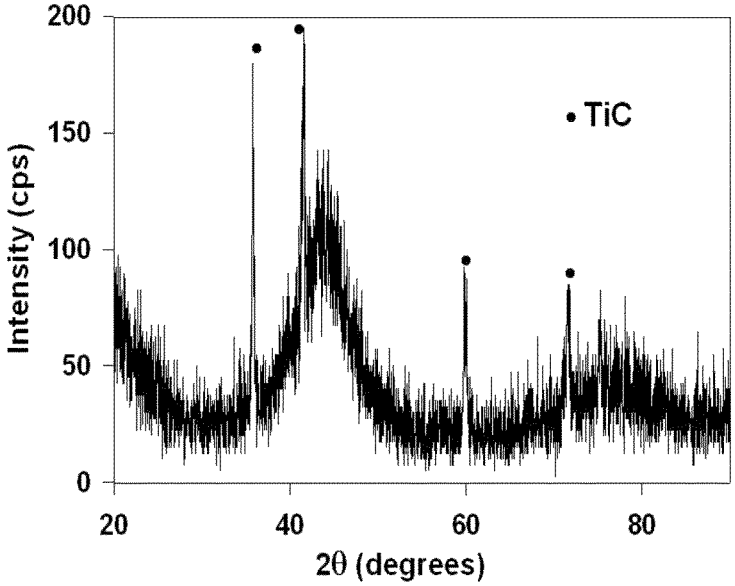
FIGS. 1(A)-(C) illustrate x-ray diffraction patterns from exemplary DVG amorphous steel composites, TiC (See FIG. 1(A)), NbC (See FIG. 1(B)), and $Fe_{23}(C,B)_6$ (See FIG. 1(C)), whereby sample pieces each of total mass of about 1 gm are obtained by crushing as-cast rods. The carbide and boride phases are labeled in the figures.

Referring to Table I, Table I. provides melting temperature, heat of formation, physical densities, and mechanical properties of refractory carbides and nitrides for comparison with monolithic DVG 101 amorphous steel, where $T_l$=liquidus temperature, ΔH (298K)=heat of formation at 298 K, ρ=mass density, $H_{Vickers}$=Vickers hardness, E=Young's modulus, B=bulk modulus, G=shear modulus, andσ=Poisson ratio. The positiveΔH (298K) noted for DVG 101 is based on a calculation for metastable $Fe_{23}C_6$ phase ($Cr_{23}C_6$ structure) [15]. Also listed are additional ceramic compounds that can be used in amorphous steel composites if consolidation instead of bulk solidification is the method of choice. $T_l$ for the latter ceramics are not listed.

TABLE I

| | $T_l$ (° C.) | ΔH (298K) (kJ/g-atom) | ρ (gm/cm³) | $H_{Vickers}$ (GPa) | E (GPa) | B (GPa) | G (GPa) | σ |
|---|---|---|---|---|---|---|---|---|
| DVG 101 | ~1160 | positive | 8.05 | 12 | 216 | 190 | 82 | 0.31-0.34 |
| TiC | 3067 | −185 | 4.91 | 35 | 510 | 390 | 186 | 0.19 |
| ZrC | 3420 | −196 | 6.59 | 26 | 440 | — | 172 | 0.19 |
| HfC | 3928 | −210 | 12.67 | 26 | 510 | >240 | 193 | 0.18 |
| VC | 2830 | −103 | 5.65 | 27 | 430 | 390 | 157 | 0.22 |
| NbC | 3600 | −141 | 7.85 | 20 | 580 | 296 | 214 | 0.21 |
| TaC | 3950 | −142 | 14.5 | 17 | 560 | 414 | 214 | 0.24 |
| $Cr_3C_2$ | 1810 | −23 | 6.74 | 18 | 24 | — | — | — |
| MoC | 2520 | −23 | 9.15 | 24 | 535 | — | — | — |
| WC | 2870 | −38 | 15.8 | 22 | 720 | — | 262 | 0.18 |
| TiN | 2950 | −338 | 5.4 | 21 | 251 | — | — | — |
| | Other ceramics | | | | | | | |
| $TiB_2$ | | | 4.6 | 34 | 367 | — | — | 0.28 |
| $B_4C$ | | | 2.5 | 32 | 450 | — | — | 0.16 |
| SiC | | | 3.2 | 28 | 400 | 226 | 196 | 0.17 |
| WC | | | 15.7 | 30 | — | 425 | — | — |
| BN | | | 3.5 | 45 | 400 | 409 | — | — |
| $Si_3N_4$ | | | 3.3 | 19 | 300 | 223 | 119 | 0.27 |

Data sources: *Handbook of refractory carbides and nitrides: properties, characteristics, processing, and applications*, H. O. Pierson, (Noyes Publications, NJ, 1996); CRC Materials Science and Engineering Handbook, ed. J. F. Shackelford and W. Alexander, (CRC Press, Boca Raton, FL, 2001); also technical data from Ames Laboratory ISU Research Foundation.

Referring to Table II, Table II provides particle size of ceramics before and after forming type-1 and type-2 DVG amorphous steel composites. The total atomic composition of the composite is equal to 100 percents. The phases detected by x-ray diffraction are also listed.

| Additives | Starting material (μm) | Embedded in composites (μm) | $2^{nd}$ phase(s) in glassy matrix |
|---|---|---|---|
| 10% NbC (type-2) | na | 3-10 | NbC |
| 10% NbC (type-1) | ~10 = 20 | ~10-20 | NbC |
| 8% TiC (type-2) | na | 1-3 | TiC |
| 8% TiC (type-1) | ~2 | 2-15, mostly ~2 | TiC(major) + $Fe_{23}C_6$ (minor) |
| 8% TiC (type-1) | ~10 | ~10 | TiC |
| 2% Mo + 4% B (type-2 | na | 2-10 | $FeMo_2B_2$ + $Fe_{23}C_6$ |
| 5% NbN (type-1) | ~10 | ~10 | NbN + unindexed phase (minor) |

Referring to Table III, Table III provides mechanical properties and physical densities of several DVG amorphous steel composites for comparison with brittle $Fe_{48}Cr_{15}Mo_{14}Er_2C_{15}B_6$ DVG 101, where ρ=mass density, FYS=fracture yield strength, E=Young's modulus, B=bulk modulus, G=shear modulus, and σ=Poisson ratio. $H_{Vickers}$ for most of the composites are measured to be 11-12 GPa; for DVG-Composite ($FeMo_2B_2$), it is measured at 12.8 GPa.

| DVG 101 and Composites | ρ (gm/cm$^3$) | FYS (GPa) | E (GPa) | B (GPa) | G (GPa) | σ |
|---|---|---|---|---|---|---|
| $Fe_{48}Cr_{15}Mo_{14}Er_2C_{15}B6$ | 8.05 | >3.8 | 216 | 190 | 82 | 0.31 |
| DVG-Composite (10% NbC) | 7.93 | — | 236 | 227 | 89 | 0.325 |
| DVG-Composite (8% TiC, 2 μm particles) | 7.8 | >4.0 | 225 | 214 | 85 | 0.325 |
| DVG-Composite (8% TiC, 10 μm particles) | 7.8 | >4.0 | | | | |
| DVG-Composite ($FeMo_2B_2$) | 7.8 | — | 224 | 206 | 85 | 0.32 |
| DVG-Composite (Fe—Mo—C) | 7.8 | >4.1 | 220 | 205 | 85 | 0.32 |

An aspect of various embodiments of the present invention provides, among other things, several practical approaches for introducing some ductility (or toughness) in brittle amorphous steels, with only a moderate reduction in the achievable thickness of the samples. For instance, compositions with about 2 and about 10 atom percent of ceramics (total composition of the composite is 100 atom percent) can be retained as about 10 mm and about 7 mm-diameter amorphous steel composite rods, respectively. Inside the rods, ceramic particulates are found embedded in a robust glass matrix. The invention products that result from the prescribed approach provide a novel series of iron-based glass composites and related method of using and making articles (e.g., systems, structures, components) of the same. The mechanical properties of amorphous steel composites also exceed those of monolithic amorphous steels.

Exemplary Invention Concepts—The toughness of amorphous steels can be enhanced via intrinsic toughening of the glassy structure, which requires the design of a new glass-forming composition, or extrinsic toughening through reduction of the driving force at the shear or crack fronts. The latter is achieved through shielding the shear band or crack tip from the external forces. Therefore, one can consider processing composites reinforced with ductile phases such as the austenitic phases. However, the latter phases are not retained in as-cast or devitrified DVG composites. The brittle fracture behavior of DVG amorphous steels call for the use of hard particulate phases to impede run-away shear bands or cracks and to encourage multiple-shear-band formation as well as crack deflection and crack branching. Crack frontal zone shielding mechanisms have been used successfully to greatly improve the fracture toughness of ceramics [16]. Table I provides a partial list of hard and thermally stable ceramic phases that have been incorporated in the present invention DVG composites.

An aspect of various embodiments of the present methods for processing type-1 DVG amorphous steels do not involve the overheating of very viscous molten alloys normally needed to fully incorporate ceramic particles to form a homogeneous glass-ceramic particulate composite mixture. Otherwise, the excessive temperature applied to the mixture would likely alter the composition of the host matrix, leaving the host in a less desirable glass-forming state. Instead, homogeneous composite precursors are prepared by mechanically mixing DVG 101 with the ceramic particles. The blended mixtures are compressed into pellets and then melted to form ingots for casting into DVG amorphous steel composite rods. The temperatures of the ingots are kept at below~1400° C., which are sufficiently higher than the melting point of DVG 101 ($T_l$~1160° C.), but much lower than the melting points of the ceramic particulates ($T_l$~3000° C.). A desired homogeneous microstructure for the composite can be selected by using a certain size distribution of the ceramic particulates. Because of the high viscosity of the DVG liquid, the microstructure is retained in the final composite product. In other words, the design of type-1 DVG composites has utilized the high viscosity of DVG 101 and large melting point gaps that exist between DVG 101 and ceramic particulates, and as well as the high thermal stability of the ceramic particulates.

In-situ growth methods are used to produce type-2 glass-ceramic DVG composites in which ceramic particles are precipitated from the melt upon cooling. In addition, the methods have also been adopted to promote more uniform particle size distributions by first forming alloy precursors. Furthermore, the high processability of DVG 101 is exploited to enable control of precipitation of ceramic phases and particle size by adjustment of the alloy composition and by changing the cooling rate of the alloy melt, to be discussed below.

Exemplary Embodiments of Invention Applied to Other Amorphous Steel Composites—An aspect of the various embodiments of the present invention has provided a viable approach to toughen high-strength BMG. Specifically, the approach has led to some toughening effects in brittle amorphous steels that are also the strongest BMG to date. An aspect of the various embodiments of the present invention concept could be applied to consolidate two-phase or other multiphase amorphous steel composite particles inside the supercooled liquid region of the glass matrix using compaction or extrusion. Amorphous steels exhibit superplastic behavior, which enables near-net-shaped products to be formed. Furthermore, different microstructures can be selected. The list of reinforcement additives can be expanded to include a wide range of hard and strong refractory and non-refractory ceramic particles that can be combined with DVG 101 amorphous steel particles in forming composites. Several, exemplary and non-limiting candidate ceramics are shown in Table I.

In an embodiment of the present invention, the amorphous steel composite has the approximate chemical formula (expressed in atomic percent):

$$[Fe_{1-a-b-c-d-e-f}Mn_aCr_bMo_c(Ln_{1-x}Y_x)_dC_eB_f]_{100-\alpha}[CER]_\alpha$$

where Ln represents an element in the Lanthanide series such as Sm, Gd, Dy, Er, Yb, and Lu; and CER represents a ceramic of one of three types:

i) a carbide or nitride comprised substantially of a composition represented by the formula:

$$M_{0.5-y}M'_yC_{0.5-z}N_z$$

where M and M' represent one or two refractory or reactive metals, such as Ti, Zr, Hf, V, Nb, and Ta, and y and z satisfy the relations $0.5 \geq y \geq 0$ and $0.5 \geq z \geq 0$; or ii) an iron-refractory carbide comprised substantially of a composition represented by the formula:

$$Fe_{1-y-z}M_yC_z$$

where M represents a refractory or reactive metal, and y and z satisfy the relations $1.0 \geq y \geq 0$ and $1.0 \geq z \geq 0$; or iii) an iron-refractory boride comprised substantially of a composition represented by the formula:

$$Fe_{1-y-z}M_yB_z$$

where M represents a refractory or reactive metal, and y and z satisfy the relations $1.0 \geq y \geq 0$ and $1.0 \geq z \geq 0$; and a, b, c, d, e, f, x, and $\alpha$ satisfy the relations: $0.12 \geq a \geq 0$, $0.18 \geq b \geq 0$, $0.18 \geq c \geq 0.05$, $0.03 \geq d > 0$, $0.18 \geq e \geq 0.12$, $0.1 \geq f \geq 0.05$, $1.0 \geq x \geq 0$, $12 \geq \alpha > 0$, $c+d \leq 0.19$, $e+f \leq 0.25$, and $a+b+c+d+e+f \leq 0.55$.

Moreover, the partial composite of $[Fe_{1-a-b-c-d-e-f}Mn_aCr_bMo_c(Ln_{1-x}Y_x)_dC_eB_f]_{100-\alpha}$ of the amorphous steel composite of $[Fe_{1-a-b-c-d-e-f}Mn_aCr_bMo_c(Ln_{1-x}Y_x)_dC_eB_f]_{100-\alpha}[CER]_\alpha$ and formulae present herein, may further include elements X and/or Z thereby defining the partial composite as $[Fe_{1-a-b-c-d-e-f}Mn_aCr_bMo_c(Ln_{1-x}Y_x)_dC_eB_fXZ]_{100-\alpha}$. Element X represents at least one transitional element, such a Co, Ni, V, Ta, Nb, W, etc. Element Z represents at least one Group B element, such as Al, Ga, P, Sb, In, Sn, Si, Ge, etc.

Exemplary Sample Preparation—Commercial grade elements (e.g. iron is at most 99.9% pure) are used in the preparation of DVG amorphous steel composites. Monolithic DVG ingots (i.e. those used for casting monolithic amorphous steel samples) are prepared by melting mixtures of the required elements in an arc furnace or induction furnace. Detailed procedures of melting the elemental mixtures have been described in our earlier International Patent Application Serial No. PCT/US2004/016442, filed May 25, 2004, entitled "Non-Ferromagnetic Amorphous Steel Alloys Obtained by Containing Large-Atom Metals" and corresponding U.S. application Ser. No. 10/559,002, filed Nov. 30, 2005. The procedures for making type-1 and type-2 DVG-composite ingots needed for casting amorphous steel composites are described below. Although in some instances mechanical mixing or/and milling is employed, it is used for producing a uniform (homogeneous) ingot or/and desired particle size, or both. The final DVG amorphous steel composites are obtained by one of the conventional casting methods. Bulk-solidifying samples are obtained using a conventional copper mold casting, for example, or other suitable methods. In one instance, bulk solidification is achieved by injecting the melt into a cylinder-shaped cavity inside a copper block. That is, the processing of DVG amorphous steel composites does not involve high-pressure compaction, extrusion, or hot isostatic pressing.

Type-1 DVG Composite Ingots: Selected Carbides or Nitrides are Mechanical milled to obtain a desired particle size distribution characterized by a dominant particle size (Table II). The particles are then mixed with the host DVG 101 ingot pieces and mechanically mixed to obtain a rather uniform powder mixture followed by compaction to form a pellet. The pellet is gently melted in an arc furnace or induction furnace to form an ingot, which is then injection cast to form DVG 101 composite rods. Evidently, the carbide particles are retained in the solid state throughout the melting of the DVG 101 host. The distributions of particles are found to be rather uniform. Subsequently, several DVG 101-carbide and nitride composites with controllable particle size distribution have been produced.

Type-2 DVG Composites Ingots: Although the descriptions are focused on the carbides, the same prescribed methods have been applied to produce DVG composites with the borides and nitrides (Tables II and III).

Particles of TiC, ZrC, NbC, TaC, and other carbides are grown in the molten DVG host. In growing X mol % of one of the carbides in the melt, X at % carbon are combined with the DVG 101 composition to form a master alloy ingot. Next, the ingot is melted with X at % of one of the refractory metals M=Ti, Zr, Nb. Since the latter elements have very high affinities for carbon (Table I), they readily form binary carbides in the melt. The alloying process can also be modified to produce smaller particle sizes by adding carbon in n steps, each step involving X/n % carbon and refractory metal. The ingot is then used to cast composite rods of various diameters.

In another method, Cr (or Mo) and M are melted together to form precursor 1. Separately, Fe, Mo (or Cr), Er, C, and FeB are melted together to form precursor 2. Finally, precursors 1 and 2 are melted together to form the final ingot which can be used to cast amorphous-metal carbide composite rods.

In yet another method, Cr (or Mo) and M in combination with ~20-40% of the Fe content are melted together to form precursor 1. Separately, the rest of Fe and appropriate amounts of Mo (or Cr), Er, C and FeB are melted together to form precursor 2. Finally, precursors 1 and 2 are melted together to obtain the final ingot.

In other type-2 composites, particles of one of the Fe—Mo—C ternary phases $Fe_2MoC$ and $Fe_3Mo_3C$ are precipitated from the melt. The precipitated carbide (or boride, e.g. $FeMo_2B_2$) as well as their particle sizes can be controlled by adjustment of the alloy composition and by changing the cooling rate of the alloy melt. For our invention DVG composites, phase and particle size selections are possible because of the significant variability of DVG 101 compositions. As a result, the processability range of type-2 DVG composites is also quite large. For example, it is known that monolithic DVG 101 samples of at least about 5 mm in diameter can be produced over a broad compositional region centered around one of the optimal compositions $Fe_{48}Cr_{15}Mo_{14}(Ln,Y)_2C_{15}B_6$ [2,3]. The region represents 5 at % variations for Mo, Cr, C, and B if only one of the latter elements is varied while keeping the others unchanged. Thus, the composite ingots can be processed by focusing on varying the elemental pairs such as (Mo, B) and (Mo, C). To promote homogeneous precipitation of the ternary carbide (or boride) phases from the melt, additional Mo (or W) and C (or B) are mechanically mixed with a master ingot of the DVG 101 to form the final ingot.

Compositions of Invention Amorphous Steel Composites—For some embodiments of the present invention, two types of amorphous steel composites are obtained, known as type-1 DVG composites and type-2 DVG composites. Both composites are constituted with DARVA-Glass 101 forming the glass matrix [2,3].

First, regarding the Type-1 DVG amorphous steel composites, these composite alloys are given by the formula (in atomic percent) as follows:

$$[Fe_{1-a-b-c-d-e-f}Mn_aCr_bMo_c(Ln_{1-x}Y_x)_dC_eB_f]_{100-\alpha}[M_{0.5-y}M'_yC_{0.5-z}N_z]_\alpha$$

where Ln=Lanthanides and preferably Sm, Gd, Dy, Er, Yb, and Lu; M and M' are either the same or different elements from the refractory metal series: Ti, Zr, Hf, V, Nb, and Ta. Also, in the formula, it is noted that $0.12 \geq a \geq 0$, $0.18 \geq b \geq 0$, $0.18 \geq c \geq 0.05$, $0.03 \geq d > 0$, $0.18 \geq e \geq 0.12$, $0.1 \geq f \geq 0.05$, $1.0 \geq x \geq 0$, $1.0 \geq y \geq 0$, $1.0 z \geq 0$, $12 \geq \alpha > 0$, and with the additional constraints $c+d \leq 0.19$, $e+f \leq 25$, and $a+b+c+d+e+f \leq 55$.

It should be appreciated that various ranges of thickness are possible. For example, the compositional range expressed in the above formula enables the present invention alloys to be processable into bulk glass composite samples with a range thickness of at least 0.1 mm or greater. In some embodiments, glass composite samples of 4-10 mm in diameter can be obtained for $0.05 \geq a \geq 0$, $0.15 \geq b \geq 0.07$, $0.16 \geq c \geq 0.07$, $0.03 \geq d > 0.015$, $0.16 \geq e \geq 0.14$, $0.07 \geq f \geq 0.05$, $1.0 \geq x \geq 0$, $1.0 \geq y \geq 0$, $1.0 \geq z \geq 0$, $10 \geq \alpha > 0$, and with the additional constraints $c+d \leq 0.19$, $e+f \leq 23$, and $a+b+c+d+e+f \leq 55$. Furthermore, the lower critical thickness increases above 4 mm as $\alpha$ decreases.

Small amounts of other elemental additions are possible but it tends to suppress the glass forming ability. Typically, these additions are introduced to enhance the processability of DVG amorphous steel alloys (See International Patent Application Serial No. PCT/US03/04049, filed Feb. 11, 2003, entitled "BULK-SOLIDIFYING HIGH MANGANESE NON-FERROMAGNETIC AMORPHOUS STEEL ALLOYS AND RELATED METHOD OF USING AND MAKING THE SAME," and corresponding U.S. application Ser. No. 10/364,123, filed Feb. 11, 2003,). Examples are Co, refractory metals (Ti, Zr, Hf, Nb, V, Ta, W), and group B elements (Al, Ga, In, Sn, Si, Ge, Sb).

Next, regarding the Type-2 DVG amorphous steel composites that contain in-situ grown ceramic particles, these alloys are given by the preferred compositions and additional variants thereafter. The preferred compositions are as follows:

$$[Fe_{1-a-b-c-d-e-f}Mn_aCr_bMo_c(Ln_{1-x}Y_x)_dC_eB_f]_{100-\alpha}[CER]_\alpha$$

CER denotes one of the many ceramics: $M_{0.5-y}M'_yC_{0.5-z}N_z$ as in type-1 composites or one of the iron-refractory-carbide and -boride compounds (chemical formulae expressed in normalized forms) given as examples in the text. Bulk glass composite samples with a range thickness of at least about 0.1 mm or greater can be formed when $0.12 \geq a \geq 0$, $0.18 \geq b \geq 0$, $0.18 \geq c \geq 0.05$, $0.03 \geq d > 0$, $0.18 \geq e \geq 0.12$, $0.1 \geq f \geq 0.05$, $1.0 \geq x \geq 0$, $1.0 \geq y \geq 0$, $1.0 \geq z \geq 0$, $12 \geq \alpha > 0$, and with the additional constraints $c+d \leq 0.19$, $e+f \leq 25$, and $a+b+c+d+e+f \leq 55$. In an embodiment, glass composite samples of about 2-6 mm in diameter can be obtained for $0.05 \geq a \geq 0$, $0.15 \geq b \geq 0.1$, $0.16 \geq c \geq 0.10$, $0.03 \geq d > 0.015$, $0.16 \geq e \geq 0.14$, $0.07 \geq f \geq 0.05$, $1.0 \geq x \geq 0$, $1.0 \geq y \geq 0$, $1.0 \geq z \geq 0$, and $10 \geq \alpha > 4$.

Figure 1B:
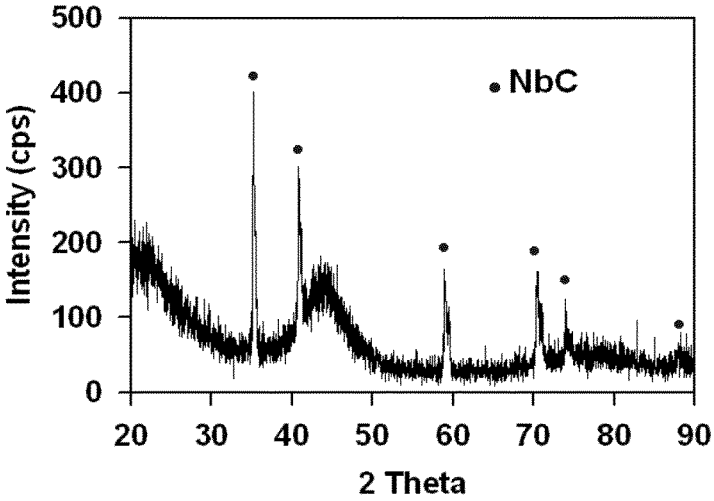
Figure 1C:
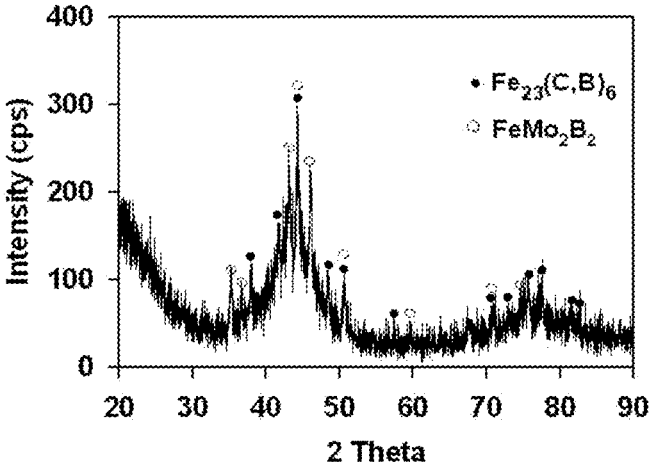
Figure 2A:
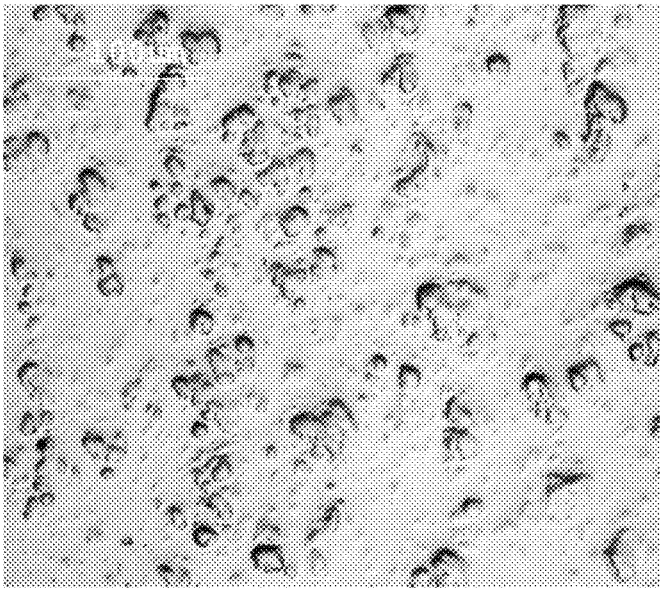
FIGS. 2(A)-(C) illustrate optical micrograph depictions for DVG composites with distributed ceramic particulates embedded in the glassy hosts, NbC (See FIG. 2(A)), $FeMo_2B_2$ (See FIG. 2(B)) and $Fe_{23}C_6$, TiC (See FIG. 2(C)).
Figure 2B:
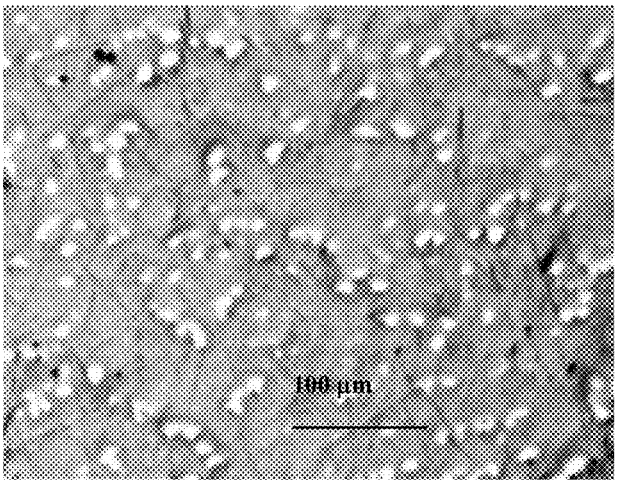
Figure 2C:
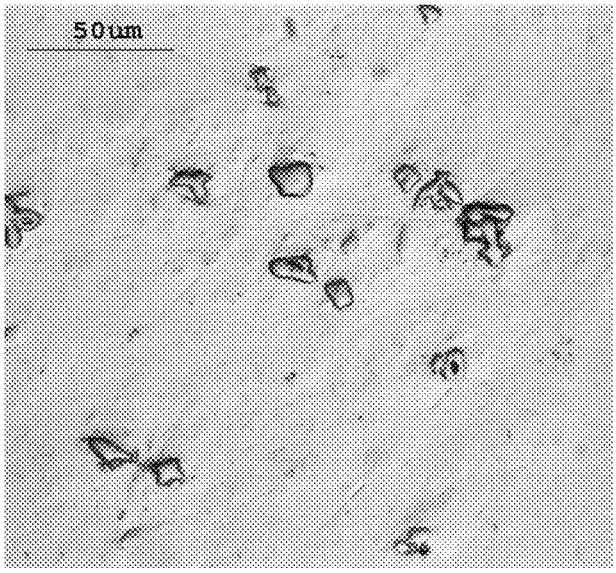

Results on Processed DVG Amorphous Steel Composites—The prepared DVG composite samples were sectioned and metallographically examined, using an optical microscope to examine the particle size distribution. X-ray (CuK$\alpha$) diffraction was performed to examine the amorphicity of the inner parts of the samples. Thermal transformation data were acquired using a Differential Thermal Analyzer (DTA). Fracture surfaces were examined using a scanning electron microscope (SEM). X-ray diffraction patterns reveal refractory-carbide or -boride reflections superimposed on the amorphous background proving that the cast rods are composites with ceramic particulates dispersed in an amorphous matrix (See FIGS. 1(A)-(C)). FIGS. 1(A)-(C) illustrate x-ray diffraction patterns from exemplary DVG amorphous steel composites, TiC (See FIG. 1(A)), NbC (See FIG. 1(B)), and $Fe_{23}(C,B)_6$ (See FIG. 1(C)), whereby sample pieces each of total mass of about 1 gm are obtained by crushing as-cast rods. The carbide and boride phases are labeled in the figures. Examination of the polished surfaces of sectioned cast rods under an optical microscope reveals fairly uniform distributions of predominantly similar size particles as well as some larger particles (See FIGS. 2(A)-(C)). FIGS. 2(A)-(C) illustrate optical micrograph depictions for DVG composites with distributed ceramic particulates embedded in the glassy hosts, NbC (See FIG. 2(A)), $FeMo_2B_2$ (See FIG. 2(B)) and $Fe_{23}C_6$, TiC (See FIG. 2(C)). The designed amorphous steel composites were found to exhibit a glass transition temperature of ~550-565° C., a supercooled liquid region $\Delta T_x$ in the range of ~30-50° C., and a crystallization temperature of about 590-605° C., indicating that the amorphous matrix is that of the DVG 101 compositions [2,3]. Therefore, the composites are thermally stable up to the crystallization temperatures of DVG 101.

Figure 3A:
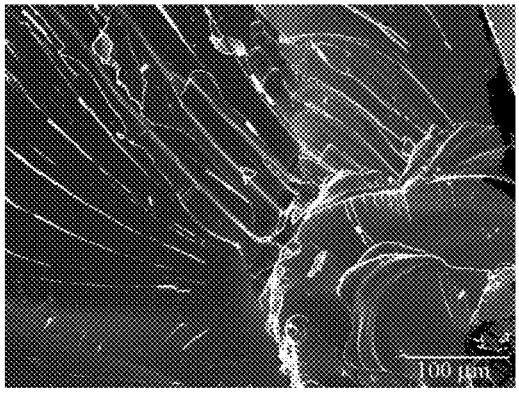
FIG. 3(A) illustrates the scanning electron micrograph depictions taken from fractured surfaces of monolithic DVG 101 amorphous steel and FIGS. 3(B)-(C) illustrate the scanning electron micrograph depictions taken from fractured surfaces of monolithic DVG-TiC composite (shown for different magnifications); the samples are fractured via a simple bending motion.
Figure 3B:
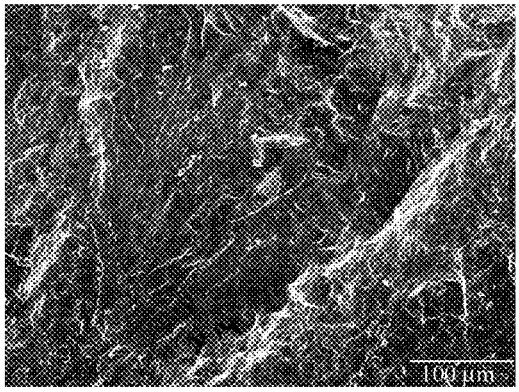
Figure 3C:
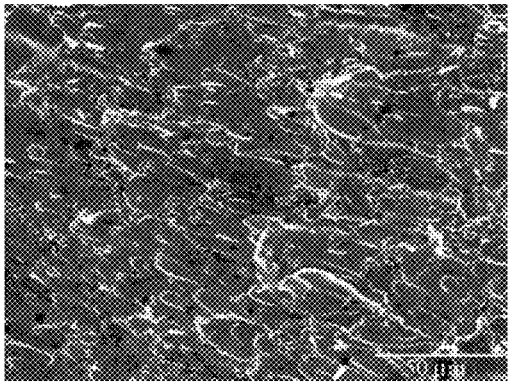

SEM examination of the fracture surfaces of DVG composites reveals multiple shear deformations and some cracks, in distinct contrast to the simple brittle crack structures seen in monolithic DVG 101, as shown in FIGS. 3(A)-(C), which indicate increased plastic deformation and impediment of crack propagation. FIG. 3(A) illustrates the scanning electron micrograph depictions taken from fractured surfaces of monolithic DVG 101 amorphous steel and FIGS. 3(B)-(C) illustrate the scanning electron micrograph depictions taken from fractured surfaces of monolithic DVG-TiC composite (shown for different magnifications); the samples are fractured via a simple bending motion. Meanwhile, there is a moderate increase in the Poisson ratio which is a measure of the transverse strain to longitudinal strain ratio. In comparison with DVG 101, the stiffness, bulk modulus, and shear modulus are seen to increase (Table III). The shear modulus is related to the fracture strength through the empirical relation FYS=G/20. Preliminary compression tests also suggest increased fracture strengths for the composites. Further compression to failure tests will be needed to determine the true plastic strain. The findings indicate that the present invention amorphous steel composites exhibit fracture strengths above about 4 GPa as well as some ductility.

In the instant exemplary embodiment, the present invention amorphous steel composites with about 2 and 10 atom percent of the ceramics (total atomic composition of the composite is 100 percent) can be cast into about 10 mm-diameter and about 7 mm-diameter rods that contain at least about 50% glassy phases, respectively. Various ranges of thickness, size, length, and volume are possible. For example, in some embodiments the present invention alloys are processable into bulk amorphous samples with a range thickness of about 0.1 mm or greater. Owing to the high glass formability and wide supercooled liquid region, the invention composites can be produced into various forms of glassy-matrix products, such as thin ribbon samples by melt spinning, powders by atomization, consolidated products, amorphous-crystalline rods, thick layers by any type of advanced spray forming or scanning-beam forming, sheets or plates by casting. Besides conventional injection casting, casting methods such as die casting, squeeze casting, and strip casting as well as other state-of the-art casting techniques currently employed in research labs and industries can also be utilized. Furthermore, one can exploit the highly deformable behavior of the alloys in the supercooled liquid region to form desired shapes of amorphous-composite products. The alloy, coatings and articles as discussed with the various embodiments of the present invention may be provided by at least one of the following processing methods: melt spinning, atomization, spray forming, scanning-beam forming, plastic forming, casting, compaction, and commercially available coating methods.

Application Domain—Accordingly, the present invention amorphous steel composites outperform current steel alloys in many application areas. Some products and services of which the present invention can be implemented includes, but is not limited thereto 1) ship, submarine (e.g., water-crafts), and vehicle (land-craft and aircraft) frames and parts, 2) building structures, 3) armor penetrators, armor penetrating projectiles or kinetic energy projectiles, 4) protection armors, armor composites, or laminate armor, 5) engineering, construction, and medical materials and tools and devices, 6) corrosion and wear-resistant coatings, 7) cell phone and personal digital assistant (PDA) casings, housings and components, 8) electronics and computer casings, housings, and components, 9) magnetic levitation rails and propulsion system, 10) cable armor, 11) composite power shaft, 12) laminate composite: laminate with other structural alloys for marine, land transportation, and aerospace applications, 13) hybrid hull of ships, wherein "metallic" portions of the hull could be replaced with steel having a hardened non-magnetic coating according to the present invention, 14) actuators and other utilization that require the combination of specific properties realizable by the present invention amorphous steel alloys. The current invention alloys may also have other useful functional applications in addition to their mechanical properties. As important as its potential practical application, from the point of scientific view, the current alloys provide an ideal system to study the fundamental issues related to glass formation ability as well as phase transition between amorphous and non-amorphous phases at high temperatures. Finally, the ideas developed herein for toughening amorphous steels can also be utilized in metallic ceramic composites systems produced by extrusion and compaction.

The following references (1-16) as cited throughout this document and below are hereby incorporated by reference herein in their entirety.

1. "Synthesis of iron-based bulk metallic glasses as non-ferromagnetic amorphous steel alloys", V. Ponnambalam, S. J. Poon, G. J. Shiflet, V. M. Keppens, R. Taylor, and G. Petculescu, Appl. Phys. Lett. 83, 1131 (2003).

2. "Fe-based bulk metallic glasses with diameter thickness larger than one centimeter," V. Ponnambalam, S. J. Poon, and G. J. Shiflet, J. Mater. Res. 19, 1320 (2004).

3. "Fe—Mn—Cr—Mo—(Y,Ln)-C—B (Ln=Lanthanides) bulk metallic glasses as formable amorphous steel alloys", V. Ponnambalam, S. J. Poon, and G. J. Shiflet, J. Mater. Research 19, 3046 (2004).

4. "Structural amorphous steels", Z. P. Lu, C. T. Liu, J. R. Thompson, and W. D. Porter, Phys. Rev. Lett. 93, 049901 (2004).

5. "Indentation fracture toughness of amorphous steel", R. Dauskardt, P. Hess, Joseph Poon, and G. J. Shiflet, submitted for publication.

6. "Mechanical properties of $Zr_{57}Nb_5Al_{10}Cu_{15.4}Ni_{12.6}$ metallic glass matrix particulate composites", R. D. Conner, H. Choi-Yim, and W. L. Johnson, J. Mater. Res. 14, 3292 (1999).

7. "Microstructural controlled shear band pattern formation and enhanced plasticity of bulk metallic glasses containing in situ formed ductile phase dendrite dispersions", C. C. Hays, C. P. Kim, and W. L. Johnson, Phys. Rev. Lett. 84, 2901 (2000).

8. "Mechanical properties of $Zr_{56.2}Ti_{13.8}Nb_{5.0}Cu_{6.9}Ni_{5.6}Be_{12.5}$ ductile phase reinforced bulk metallic glass composite", F. Szuecs, C. P. Kim, and W. L. Johnson, Acta Mater. 49, 1507 (2001).

9. "ZrNbCuNiAl bulk metallic glass matrix composites containing dendritic bcc phase precipitates", U. Kuehn, J. Eckert, N. Mattern, and L. Schultz, Appl. Phys. Lett. 80, 2478 (2002).

10. "Metallic glass matrix composite with precipitated ductile reinforcement", C. Fan, R. T. Ott, and T. C. Hufnagel, Appl. Phys. Lett. 81, 1020 (2002).

11. "Structural and properties of Zr—Ta—Cu—Ni—Al bulk metallic glasses and metallic glass matrix composites", Fan, R. T. Ott, and T. C. Hufnagel, J. Non-Cryst. Solids 317, 158 (2003).

12. "Relation between short-range order and crystallization behavior in Zr-based amorphous alloys", L. Q. Xing, T. C. Hufnagel, J. Eckert, W. Löser, and L. Schultz, Appl. Phys. Lett. 77, 970 (2000).

13. "Ceramics particulate reinforced $Mg_{65}Cu_{20}Zn_5Y_{10}$ bulk metallic glass composites", Y. K. Xu and J. Xu, Scripta Mater. 49, 843 (2003).

14. "Mg-based bulk metallic glass composites with plasticity and high strength", H. Ma, J. Xu, and E. Ma, Appl. Phys. Lett. 83, 2793 (2003).

15. "Stability of Fe-based alloys with structure type $C_6Cr_{23}$", M. Widom and M. Mihalkovic, J. Mater. Res. 20, 237 (2005).

16. "Toughening behavior of a two-dimensional SiC/SiC woven composite at ambient temperature: I, Damage initiation and R-curve behavior", S. V. Nair and Y. L. Wang, J. Am. Ceram. Soc. 81, 1149 (1998).

The various embodiments of the present invention material, structures, method of using and fabrication may be implemented with the embodiments disclosed in the following patents, patent applications, references and publications as listed below and are hereby incorporated by reference herein in their entirety:

U.S. Pat. No. 6,709,536 to Kim et al. entitled "In-situ ductile metal/bulk metallic glass matrix composites formed by chemical partitioning;"

U.S. Pat. No. 6,692,590 to Xing et al. entitled "Alloy with metallic glass and quasi-crystalline properties;"

U.S. Pat. No. 6,669,793 to Hays entitled "Microstructure controlled shear band pattern formation in ductile metal/bulk metallic glass matrix composites prepared by SLR processing;"

U.S. Pat. No. 6,652,679 to Inoue et al. entitled "Highly-ductile nano-particle dispersed metallic glass and production method there for;"

U.S. Pat. No. 6,592,689 to Hays entitled "Fractional variation to improve bulk metallic glass forming capability;"

U.S. Pat. No. 6,515,382 to Ullakko entitled "Actuators and Apparatus;"

U.S. Pat. No. 6,505,571 to Critchfield et al. entitled "Hybrid Hull Construction for Marine Vessels;"

U.S. Pat. No. 6,446,558 to Peker et al. entitled "Shaped-Charge Projectile having an Amorphous-Matrix Composite Shaped-charge Filter;"

U.S. Pat. No. 6,357,332 to Vecchio entitled "Process for Making Metallic/intermetallic Composite Laminate Material and Materials so Produced Especially for Use in Lightweight Armor;"

U.S. Pat. No. 6,284,061 to Inoue A. et al. entitled "Soft Magnetic Amorphous Alloy and High Hardness Tool Using the Same;"

U.S. Pat. No. 6,280,536 to Inoue A. et al. entitled "FE Based Hard Magnetic Alloy Having Super-Cooled Liquid Region;"

U.S. Pat. No. 6,172,589 to Fujita K. et al. entitled "Hard Magnetic Alloy Having Supercooled Liquid Region, Sintered or Cast Product Thereof or Stepping Motor and Speaker Using the Alloy;"

U.S. Pat. No. 6,057,766 to O'Handley et al. entitled "Iron-rich Magnetostrictive Element Having Optimized Bias-Field-Dependent Resonant Frequency Characteristic;"

U.S. Pat. No. 6,010,580 to Dandliker et al. entitled "Composite penetrator;"

U.S. Pat. No. 5,976,274 to Inoue A. et al. entitled "Soft Magnetic Amorphous Alloy and High Hardness Amorphous Alloy and High Hardness Tool Using the Same;"

U.S. Pat. No. 5,961,745 to Inoue A. et al. entitled "FE Based Soft Magnetic Glassy Alloy;"

U.S. Pat. No. 5,896,642 to Peker et al. entitled "Die-formed Amorphous Metallic Articles and their Fabrication;"

U.S. Pat. No. 5,886,254 to Peker et al. entitled "Amorphous metal/reinforcement composite material;"

U.S. Pat. No. 5,868,077 to Kuznetsov entitled "Method and Apparatus for Use of Alternating Current in Primary Suspension Magnets for Electrodynamic Guidance with Superconducting Fields;"

U.S. Pat. No. 5,820,963 to Lu et al. entitled "Method of Manufacturing a Thin Film Magnetic Recording Medium having Low MrT Value and High Coercivity;"

U.S. Pat. No. 5,797,443 to Lin, Johnson, and Peker entitled "Method of Casting Articles of a Bulk-Solidifying Amorphous Alloy;"

U.S. Pat. No. 5,738,733 to Inoue A. et al. entitled "Ferrous Metal Glassy Alloy;"

U.S. Pat. No. 5,732,771 to Moore entitled "Protective Sheath for Protecting and Separating a Plurality for Insulated Cable Conductors for an Underground Well;"

U.S. Pat. No. 5,728,968 to Buzzett et al. entitled "Armor Penetrating Projectile;"

U.S. Pat. No. 5,626,691 to Li et al. entitled "Bulk Nanocrystalline Titanium Alloys with High Strength;"

U.S. Pat. No. 5,567,251 to Peker et al. entitled "Amorphous metal/reinforcement composite material;"

U.S. Pat. No. 5,228,349 to Gee et al. entitled "Composite Power Shaft with Intrinsic Parameter Measurability;"

U.S. Pat. No. 4,676,168 to Cotton et al. entitled "Magnetic Assemblies for Minesweeping or Ship Degaussing;"

U.S. Pat. No. 4,562,951 to Cytron entitled "Method of making metallic glass-metal matrix composites;"

U.S. Pat. No. 4,353,305 to Moreau, et al. entitled "Kinetic-energy Projectile;"

U.S. Pat. No. 4,268,564 to Narasimhan, entitled "Strips of metallic glasses containing embedded particulate matter;"

U.S. Pat. No. 4,061,815 to Poole entitled "Novel Compositions;"

U.S. Patent Application Publication No. US 2005/0034792 A1 (Ser. No. 10/639,277) to Lu et al.; and U.S. Patent Application Publication No. US 2004/00154701 A1 (Ser. No. 10/364,988) to Lu et al.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Unless clearly specified to the contrary, there is no requirement for any particular described or illustrated activity or element, any particular sequence or such activities, any particular size, speed, material, dimension or frequency, or any particularly interrelationship of such elements. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all sub ranges therein. Any information in any material (e.g., a United States/foreign patent, United States/foreign patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

We claim:

1. A method for enhancing the toughness of amorphous steel alloy that comprises:

a) milling carbide or nitride ceramic particulates to obtain a desired particle size distribution;

b) mixing the milled particles with ingots of monolithic amorphous steel alloy;

c) compacting the mixture to form a pellet; and c) melting the pellet at a temperature above the melting point for the steel but below the melting point for the ceramic to form a composite ingot.

2. The method of claim 1 further comprising:

a) preparing ingots of monolithic amorphous steel alloy; and b) casting the resulting ingot to form an amorphous steel composite.

3. The method of claim 2, wherein the composite produced is the amorphous steel composite comprising a composition represented by the formula:

$$[Fe_{1-a-b-c-d-e-f}Mn_aCr_bMo_c(Ln_{1-x}Y_x)_dC_eB_f]_{100-\alpha}[CER]_\alpha$$

wherein Ln represents an element in the Lanthanide series such as Sm, Gd, Dy, Er, Yb, or Lu; and wherein CER represents a ceramic consisting of one of three types:

i) a carbide or nitride comprised substantially of a composition represented by the formula:

$$M_{0.5-y}M'_yC_{0.5-z}N_z$$

wherein M and M' represent one or two group IV or V refractory metals such as Ti, Zr, Hf, V, Nb, or Ta, and wherein y and z satisfy the relations 0.5≥y≥0 and 0.5.z≥0; or ii) an iron-refractory carbide comprised substantially of a composition represented by the formula:

$$Fe_{1-y-z}M_yC_z$$

wherein M represents a refractory or reactive metal, and wherein y and z satisfy the relations 1.0≥y≥0 and 1.0≥z≥0; or iii) an iron-refractory boride comprised substantially of a composition represented by the formula:

$$Fe_{1-y-z}M_yB_z$$

wherein M represents a refractory or reactive metal, and wherein y and z satisfy the relations 1.0≥y≥0 and 1.0≥z≥0; and wherein a, b, c, d, e, f, x, and α satisfy the relations: 0.12≥a≥0, 0.18≥b≥0, 0.18≥c≥0.05, 0.03≥d>0, 0.18≥e≥0.12, 0.1≥f≥0.05, 1.0≥x≥0, 12≥α>0, c+d≤0.19, e+f≤0.25, and a+b+c+d+e+f≤0.55.

4. The method of claim 3, wherein the partial composite of $[Fe_{1-a-b-c-d-e-f}Mn_aCr_bMo_c(Ln_{1-x}Y_x)_dC_eB_f]_{100-\alpha}$ further comprises elements X and/or Z, wherein:

X represents at least one transitional element, and

Z represents at least one Group B element.

5. The method of claim 2, wherein the amorphous steel composite produced is at least about 0.1 mm in thickness in its minimum dimension.

6. The method of claim 2, wherein the amorphous steel composite produced has a fracture yield strength of at least about 4.0 GPa.

7. The method of claim 2, wherein the amorphous steel composite produced has a Young's modulus of at least about 220 GPa.

8. The method of claim 2, wherein the amorphous steel composite produced has a bulk modulus of at least about 205 GPa.

9. The method of claim 2, wherein the amorphous steel composite produced has a shear modulus of at least about 85 GPa.

10. The method of claim 2, wherein the amorphous steel composite produced has a Poisson ratio of at least about 0.32.

11. A method for enhancing the toughness of amorphous steel alloy that comprises:

a) combining monolithic amorphous steel with Carbon, Boron, or Nitrogen to form a master alloy ingot;

b) melting the master alloy ingot at a temperature above the melting point for the steel but below the melting point for the ceramic;

c) mixing a group IV or V refractory metal in the melt to form ceramic particulates within the composite ingot; and d) repeating the process as necessary to achieve the desired particle size and ceramic content.

12. The method of claim 11 further comprising:

a) preparing ingots of monolithic amorphous steel alloy; and b) casting the resulting ingot to form an amorphous steel composite.

13. The method of claim 12, wherein the composite produced is the amorphous steel composite comprising a composition represented by the formula:

$$[Fe_{1-a-b-c-d-e-f}Mn_aCr_bMo_c(Ln_{1-x}Y_x)_dC_eB_f]_{100-\alpha}[CER]_\alpha$$

wherein Ln represents an element in the Lanthanide series such as Sm, Gd, Dy, Er, Yb, or Lu; and wherein CER represents a ceramic consisting of one of three types:

i) a carbide or nitride comprised substantially of a composition represented by the formula:

$$M_{0.5-y}M'_yC_{0.5-z}N_z$$

wherein M and M' represent one or two group IV or V refractory metals such as Ti, Zr, Hf, V, Nb, or Ta, and wherein y and z satisfy the relations 0.5≥y≥0 and 0.5.z≥0; or ii) an iron-refractory carbide comprised substantially of a composition represented by the formula:

$$Fe_{1-y-z}M_yC_z$$

wherein M represents a refractory or reactive metal, and wherein y and z satisfy the relations 1.0≥y≥0 and 1.0≥z≥0; or iii) an iron-refractory boride comprised substantially of a composition represented by the formula:

$$Fe_{1-y-z}M_yB_z$$

wherein M represents a refractory or reactive metal, and wherein y and z satisfy the relations 1.0≥y≥0 and 1.0≥z≥0; and wherein a, b, c, d, e, f, x, andα satisfy the relations: 0.12≥a≥0, 0.18≥b≥0, 0.18≥c≥0.05, 0.03≥d>0, 0.18≥e≥0.12, 0.1≥f≥0.05, 1.0≥x≥0, 12≥α>0, c+d≤0.19, e+f≤0.25, and a+b+c+d+e+f≤0.55.

14. The method of claim 13, wherein the partial composite of $[Fe_{1-a-b-c-d-e-f}Mn_aCr_bMo_c(Ln_{1-x}Y_x)_dC_eB_f]_{100-\alpha}$ further comprises elements X and/or Z, wherein:

X represents at least one transitional element, and

Z represents at least one Group B element.

15. The method of claim 12, wherein the amorphous steel composite produced is at least about 0.1 mm in thickness in its minimum dimension.

16. The method of claim 12, wherein the amorphous steel composite produced has a fracture yield strength of at least about 4.0 GPa.

17. The method of claim 12, wherein the amorphous steel composite produced has a Young's modulus of at least about 220 GPa.

18. The method of claim 12, wherein the amorphous steel composite produced has a bulk modulus of at least about 205 GPa.

19. The method of claim 12, wherein the amorphous steel composite produced has a shear modulus of at least about 85 GPa.

20. The method of claim 12, wherein the amorphous steel composite produced has a Poisson ratio of at least about 0.32.

21. A method for enhancing the toughness of amorphous steel alloy that comprises:

a) milling ceramic particulates to obtain a desired particle size distribution;

b) mixing the ceramic particulates with ingots of monolithic amorphous steel alloy;

c) melting the mixture at a temperature above the melting point for the steel but below the melting point for the ceramic; and d) precipitating the ceramic particulates from the mixture as it cools into a composite ingot.

22. The method of claim 21 further comprising:

a) preparing ingots of monolithic amorphous steel alloy; and b) casting the resulting ingot to form an amorphous steel composite.

23. The method of claim 22, wherein the composite produced is the amorphous steel composite comprising a composition represented by the formula:

$$[Fe_{1-a-b-c-d-e-f}Mn_aCr_bMo_c(Ln_{1-x}Y_x)_dC_eB_f]_{100-\alpha}[CER]_\alpha$$

wherein Ln represents an element in the Lanthanide series such as Sm, Gd, Dy, Er, Yb, or Lu; and wherein CER represents a ceramic consisting of one of three types:

i) a carbide or nitride comprised substantially of a composition represented by the formula:

$$M_{0.5-y}M'_yC_{0.5-z}N_z$$

wherein M and M' represent one or two group IV or V refractory metals such as Ti, Zr, Hf, V, Nb, or Ta, and wherein y and z satisfy the relations 0.5≥y≥0 and 0.5.z≥0; or ii) an iron-refractory carbide comprised substantially of a composition represented by the formula:

$$Fe_{1-y-z}M_yC_z$$

wherein M represents a refractory or reactive metal, and wherein y and z satisfy the relations 1.0≥y≥0 and 1.0≥z≥0; or iii) an iron-refractory boride comprised substantially of a composition represented by the formula:

$$Fe_{1-y-z}M_yB_z$$

wherein M represents a refractory or reactive metal, and wherein y and z satisfy the relations 1.0≥y≥0 and 1.0≥z≥0; and wherein a, b, c, d, e, f, x, and α satisfy the relations:

0.12≥a≥0, 0.18≥b≥0, 0.18≥c≥0.05, 0.03≥d>0, 0.18≥e≥0.12, 0.1≥f≥0.05, 1.0≥x≥0, 12≥α>0, c+d≤0.19, e+f≤0.25, and a+b+c+d+e+f≤0.55.

24. The method of claim 23, wherein the partial composite of $[Fe_{1-a-b-c-d-e-f}Mn_aCr_bMo_c(Ln_{1-x}Y_x)_dC_eB_f]_{100-\alpha}$ further comprises elements X and/or Z, wherein:

X represents at least one transitional element, and

Z represents at least one Group B element.

25. The method of claim 22, wherein the amorphous steel composite produced is at least about 0.1 mm in thickness in its minimum dimension.

26. The method of claim 22, wherein the amorphous steel composite produced has a fracture yield strength of at least about 4.0 GPa.

27. The method of claim 22, wherein the amorphous steel composite produced has a Young's modulus of at least about 220 GPa.

28. The method of claim 22, wherein the amorphous steel composite produced has a bulk modulus of at least about 205 GPa.

29. The method of claim 22, wherein the amorphous steel composite produced has a shear modulus of at least about 85 GPa.

30. The method of claim 22, wherein the amorphous steel composite produced has a Poisson ratio of at least about 0.32.

31. A method of producing feedstock for an amorphous steel composite comprising a composition represented by the formula:

$$[Fe_{1-a-b-c-d-e-f}Mn_aCr_bMo_c(Ln_{1-x}Y_x)_dC_eB_f]_{100-\alpha}[CER]_\alpha$$

wherein Ln represents an element in the Lanthanide series such as Sm, Gd, Dy, Er, Yb, or Lu; and wherein CER represents a ceramic consisting of one of three types:

i) a carbide or nitride comprised substantially of a composition represented by the formula:

$$M_{0.5-y}M'_yC_{0.5-z}N_z$$

wherein M and M' represent one or two group IV or V refractory metals such as Ti, Zr, Hf, V, Nb, or Ta, and wherein y and z satisfy the relations 0.5≥y≥0 and 0.5.z≥0; or ii) an iron-refractory carbide comprised substantially of a composition represented by the formula:

$$Fe_{1-y-z}M_yC_z$$

wherein M represents a refractory or reactive metal, and wherein y and z satisfy the relations 1.0≥y≥0 and 1.0≥z≥0; or iii) an iron-refractory boride comprised substantially of a composition represented by the formula:

$$Fe_{1-y-z}M_yB_z$$

wherein M represents a refractory or reactive metal, and wherein y and z satisfy the relations 1.0≥y≥0 and 1.0≥z≥0; and wherein a, b, c, d, e, f, x, and α satisfy the relations:

0.12≥a≥0, 0.18≥b≥0, 0.18≥c≥0.05, 0.03≥d>0, 0.18≥e≥0.12, 0.1≥f≥0.05, 1.0≥x≥0, 12≥α>0, c+d≤0.19, e+f≤0.25, and a+b+c+d+e+f≤0.55, that comprises the steps:

a) preparing a precursor by melting together a group IV or V refractory metal with Chromium or Molybdenum;

b) preparing a separate precursor by melting together Iron, Erbium, and Iron Boride with Chromium or Molybdenum and either Carbon, Boron, or Nitrogen; and c) melting the two precursors at a temperature above the melting point for the steel but below the melting point for the ceramic to form a single ingot.

32. The method of claim 31 for producing the amorphous steel composite comprising the step of casting the ingot to form the amorphous steel composite.

33. The method of claim 31, wherein the partial composite of $[Fe_{1-a-b-c-d-e-f}Mn_aCr_bMo_c(Ln_{1-x}Y_x)_dC_eB_f]_{100-\alpha}$ further comprises elements X and/or Z, wherein:

X represents at least one transitional element, and

Z represents at least one Group B element.

34. A method of producing feedstock for an amorphous steel composite comprising a composition represented by the formula:

$$[Fe_{1-a-b-c-d-e-f}Mn_aCr_bMo_c(Ln_{1-x}Y_x)_dC_eB_f]_{100-\alpha}[CER]_\alpha$$

wherein Ln represents an element in the Lanthanide series such as Sm, Gd, Dy, Er, Yb, or Lu; and wherein CER represents a ceramic consisting of one of three types:

i) a carbide or nitride comprised substantially of a composition represented by the formula:

$$M_{0.5-y}M'_yC_{0.5-z}N_z$$

wherein M and M' represent one or two group IV or V refractory metals such as Ti, Zr, Hf, V, Nb, or Ta, and wherein y and z satisfy the relations 0.5≥y≥0 and 0.5.z≥0; or ii) an iron-refractory carbide comprised substantially of a composition represented by the formula:

$$Fe_{1-y-z}M_yC_z$$

wherein M represents a refractory or reactive metal, and wherein y and z satisfy the relations 1.0≥y≥0 and 1.0≥z≥0; or iii) an iron-refractory boride comprised substantially of a composition represented by the formula:

$$Fe_{1-y-z}M_yB_z$$

wherein M represents a refractory or reactive metal, and wherein y and z satisfy the relations 1.0≥y≥0 and 1.0≥z≥0; and wherein a, b, c, d, e, f, x, and α satisfy the relations: 0.12≥a≥0, 0.18≥b≥0, 0.18≥c≥0.05, 0.03≥d>0, 0.18≥e≥0.12, 0.1≥f≥0.05, 1.0≥x≥0, 12≥α>0, c+d≤0.19, e+f≤0.25, and a+b+c+d+e+f≤0.55, that comprises the steps:

a) preparing a precursor by melting together a group IV or V refractory metal with Chromium or Molybdenum in combination with about 20 to 40% of the desired Iron content;

b) preparing a separate precursor by melting together the remaining Iron content with Erbium and Iron Boride, Chromium or Molybdenum, and either Carbon, Boron, or Nitrogen; and c) melting the two precursors at a temperature above the melting point for the steel but below the melting point for the ceramic to form a single ingot.

35. The method of claim 34 for producing the amorphous steel composite comprising the step of casting the ingot to form the amorphous steel composite.

36. The method of claim 34, wherein the partial composite of $[Fe_{1-a-b-c-d-e-f}Mn_aCr_bMo_c(Ln_{1-x}Y_x)_dC_eB_f]_{100-\alpha}$ further comprises elements X and/or Z, wherein:

X represents at least one transitional element, and

Z represents at least one Group B element.

* * * * *